US006457189B1

(12) United States Patent
Kindness

(10) Patent No.: US 6,457,189 B1
(45) Date of Patent: Oct. 1, 2002

(54) POOL LINER RETAINER WITH CAP

(75) Inventor: William Kindness, Toronto (CA)

(73) Assignee: Kafko International Inc., Mississauga (CA)

( * ) Notice: Subject to any disclaimer, the term of this patent is extended or adjusted under 35 U.S.C. 154(b) by 0 days.

(21) Appl. No.: 10/010,276

(22) Filed: Nov. 5, 2001

(51) Int. Cl.[7] ..... E04H 4/14
(52) U.S. Cl. ..... 4/506
(58) Field of Search ..... 4/506, 496, 488

(56) References Cited

U.S. PATENT DOCUMENTS 3,512,326 A * 5/1970 Greene ..... 4/506
3,777,318 A * 12/1973 Stillman, Jr. ..... 4/506
4,064,571 A * 12/1977 Phipps ..... 4/506
4,158,244 A 6/1979 Stefan
4,229,844 A * 10/1980 Cribben et al. ..... 4/506
4,601,073 A * 7/1986 Methot ..... 4/506
4,713,849 A 12/1987 Kindness
4,967,424 A * 11/1990 Stegmeier ..... 4/506

* cited by examiner

*Primary Examiner*—Charles R. Eloshway
(74) *Attorney, Agent, or Firm*—Ridout & Maybee LLP

(57) ABSTRACT

A retainer for a pool liner has an elongate retaining element includes a longitudinal holding channel for accommodating a liner bead, the channel having an upper wall with a downwardly extending second flange, a rear wall and a bottom wall with a forwardly positioned upwardly extending first flange. The area between the second flange and the first flange forms a slot for insertion of the bead into the channel. A third flange is positioned outside of said channel on the upper wall. An elongate resilient cap has a first hooked peripheral edge portion for hooking over the second flange, and an opposed second hooked peripheral edge portion for hooking over the third flange. The cap can be retained by snapping the hooked portions over the respective second and third flanges. The first peripheral edge portion has an outwardly disposed shoulder extending toward the first flange. When the cap is snapped in place, the shoulder is spaced sufficiently from the first flange to allow the width of the liner bead to pass therethrough but not sufficiently to allow the height of the liner bead to pass therethrough.

20 Claims, 5 Drawing Sheets

POOL LINER RETAINER WITH CAP

FIELD OF THE INVENTION

This invention relates to devices for retaining the top peripheral edge portion of a watertight liner such as the type used in the construction of swimming pools.

BACKGROUND OF THE INVENTION

A common and well known method of constructing swimming pools comprises the erection or placement of fixed walls and a floor for the pool which are not watertight but which have sufficient structural strength to contain the water. A pool liner is required in such a pool to make it watertight. The liner is constructed from a waterproof sheet material which often made is from vinyl. The liner has a top peripheral edge portion that corresponds with or is located adjacent to the top of the structural walls of the pool. Various methods have been proposed and used to attach the top peripheral edge of the liner to the top of the pool walls in order to ensure that the liner does not slip down below the water line. Many of these methods involve the use of preformed coping members which finish and round the top peripheral edge of the pool for safety and attractive appearance. Commonly, a groove or slot is provided in this coping for receiving a thickened liner bead formed on the top peripheral edge portion of the liner. A longitudinal flange located adjacent to the mouth of the slot engages a corresponding flange or lip in the liner bead in order to retain the liner edge. One difficulty with such a method arises from the fact that in order to insert the liner bead into the slot, the bead and slot must be dimensioned loosely. This fact can result in the liner being pulled out of the coping slot. If this should occur, the liner normally cannot be reinserted into the coping without draining the pool.

In U.S. Pat. No. 4,158,244 issued Jun. 19, 1979 to Timerax Holdings Ltd. a coping or retaining element, in addition to having a holding channel for accommodating the liner bead, has a generally cylindrical hinge channel communicating with the holding channel. An elongate resilient U-shaped insert is located in the hinge channel. This insert has an outward closing element depending from the hinge channel to partially close a longitudinal outward slot defined by the two channels. A rib arrangement is provided to prevent rotation of the insert in the hinge channel. The closing element is biased towards the slot so that, after insertion of the liner bead, the insert engages a stop, partially closes the slot, and retains the liner bead. While this retainer works well, it requires the insert to be installed inside the retaining element, which is inconvenient.

U.S. Pat. No. 4,713,849 issued Dec. 22, 1987 discloses a retaining element defining a holding channel adapted to accommodate the bead of the pool liner. The channel defines an outwardly disposed longitudinal slot for insertion of the bead into the channel. The retaining element includes a downwardly extending flange forming an upper edge of the slot. An elongate clip has a longitudinal cavity extending there along adapted to receive the flange, the clip partially closing the slot. After the bead has been inserted into the slot, the clip can be mounted on the flange to partially close the slot and retain the liner bead. While this retainer also works very well, a difficulty with it is that once the bead has been inserted into the slot and the clip mounted on the flange, the bead cannot be removed from the slot without removing the clip. Removal of the clip tends to cause damage either to the clip or the retaining element.

SUMMARY OF THE INVENTION

The present invention provides a retainer structure which is easy to install yet capable of retaining the top peripheral edge portion or bead of a pool liner while allowing the liner bead to be easily removed from such retainer, if desired.

According to one aspect of the present invention, there is provided a retainer for accommodating a pool liner having a bead with a height greater than its width and an offset lateral edge portion. The retainer comprises an elongate retaining element including means defining a longitudinal holding channel for accommodating the pool liner bead. The holding channel has an upper wall, a rear wall and a bottom wall. The bottom wall has a forwardly positioned, upwardly extending first flange and the upper wall has a downwardly extending second flange. The second flange extends from the upper wall toward the bottom wall and the area between the bottom of the second flange and the top of the first flange forms a slot for insertion of the liner bead into the holding channel. The upper wall also has a remotely extending third flange positioned outside of the channel. An elongate resilient cap defining a longitudinal cavity therein is also provided. The cap has a first hooked peripheral edge portion adapted to be hooked over the second flange, and an opposed second hooked peripheral edge portion adapted to be hooked over the third flange. The cap is retained on the retainer by snapping the hooked peripheral edge portions over the respective second and third flanges. The first peripheral edge portion has a transverse, outwardly disposed shoulder. When the cap is retained on the retainer, the cap shoulder extends toward the first flange but is spaced from the first flange a distance sufficient to allow the width of the liner bead to pass therethrough but not sufficient to allow the height of the liner bead to pass therethrough. The liner bead can be inserted into the retaining element with the liner bead lateral edge portion inside the first flange so that downward forces acting on said pool liner will cause the liner bead lateral edge portion to hook onto said first flange and swing into engagement with the cap shoulder, the cap shoulder thereby preventing separation of said liner bead from said holding channel.

According to another aspect of the invention, there is provided a swimming pool liner and retainer assembly comprising, in combination, a pool liner including a waterproof sheet having a top peripheral edge portion including a liner bead, the liner bead having a height greater than its width and an offset lateral edge portion, and a retainer as described next above, the liner bead being held in the retaining element by the cap.

Further features and advantages of the invention will become apparent from the following detailed description, taken in conjunction with the accompanying drawings, in which:

DETAILED DESCRIPTION OF THE PREFERRED EMBODIMENTS

Figure 1:
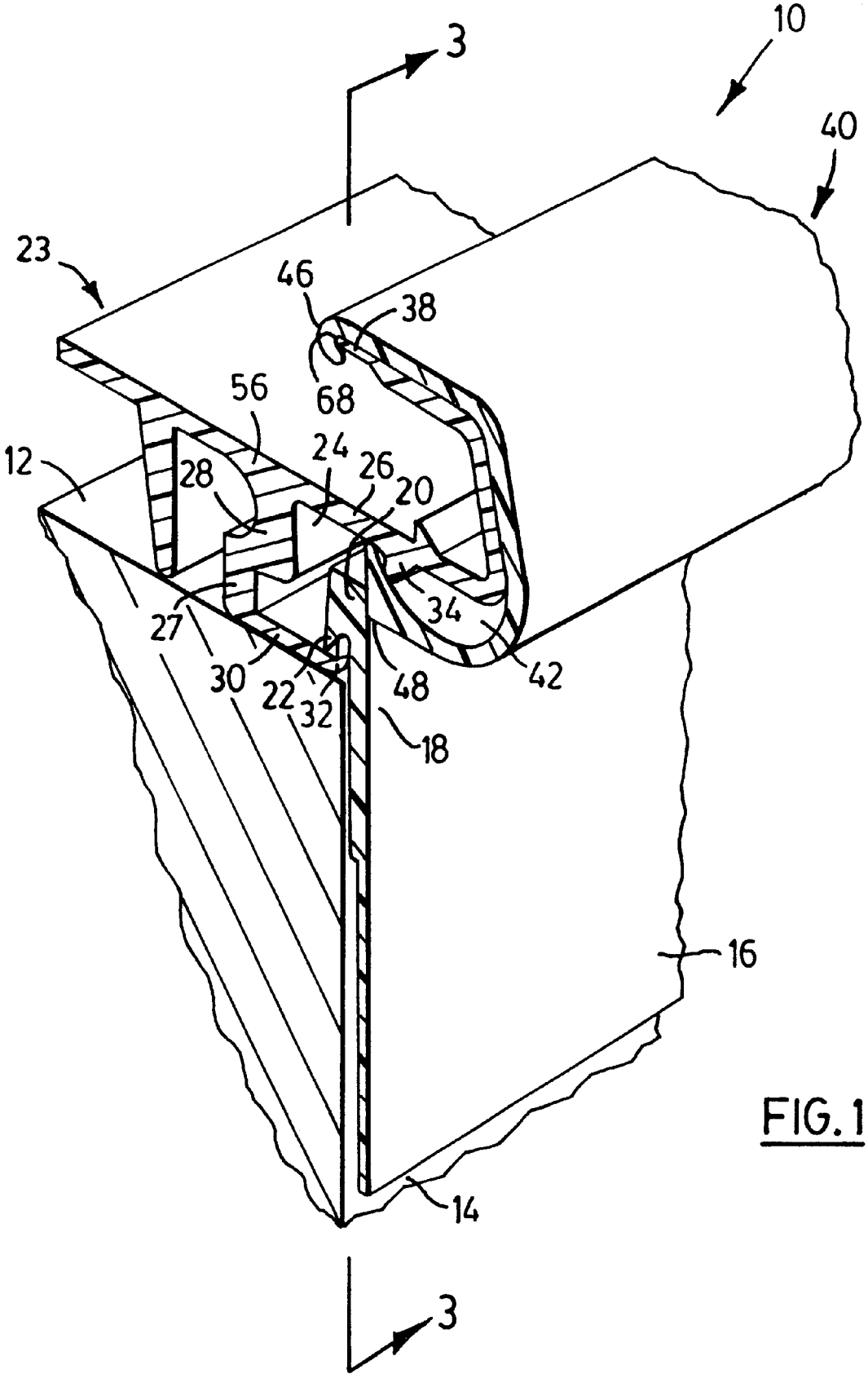
FIG. 1 is a perspective sectional view of a first embodiment of pool liner retainer constructed in accordance with the present invention.

In the description below, like reference numerals are used to indicate components which are similar in the various embodiments of the present invention. Primed reference numerals are used to indicate different variants of the similar components.

Figure 3:
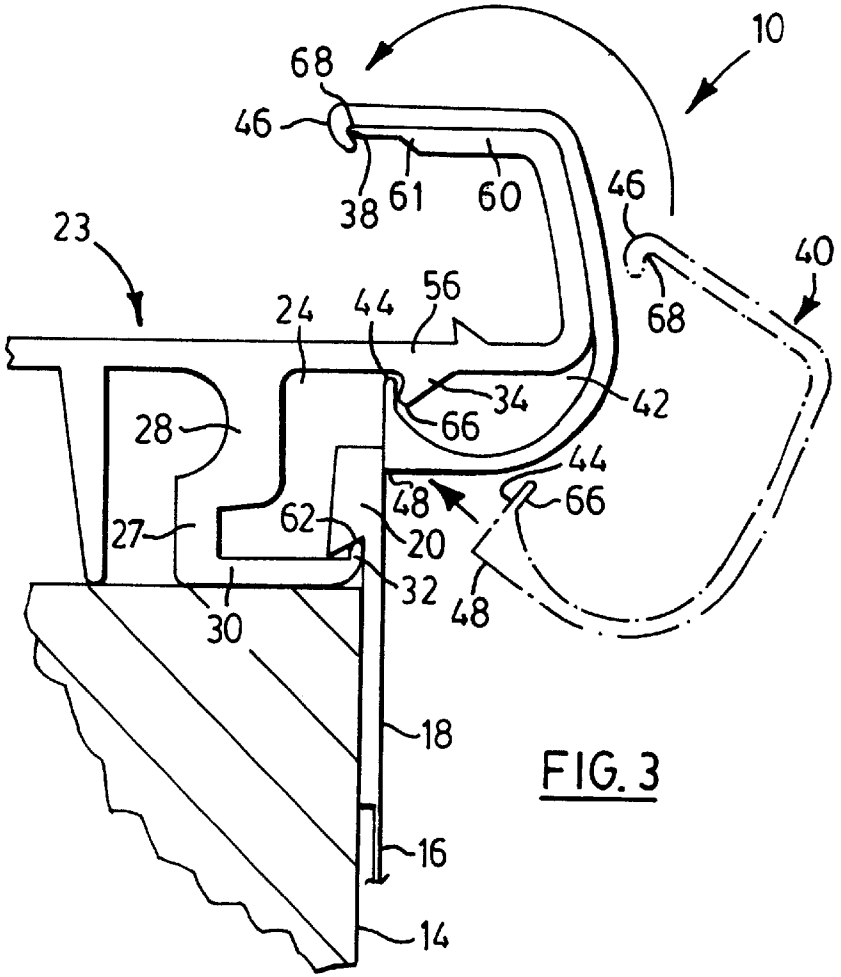
FIG. 3 is a cross-sectional view taken along lines 3—3 of FIG. 1 illustrating how the cap is attached to the retaining element in order to hold the liner bead in the holding channel.
Figure 2:
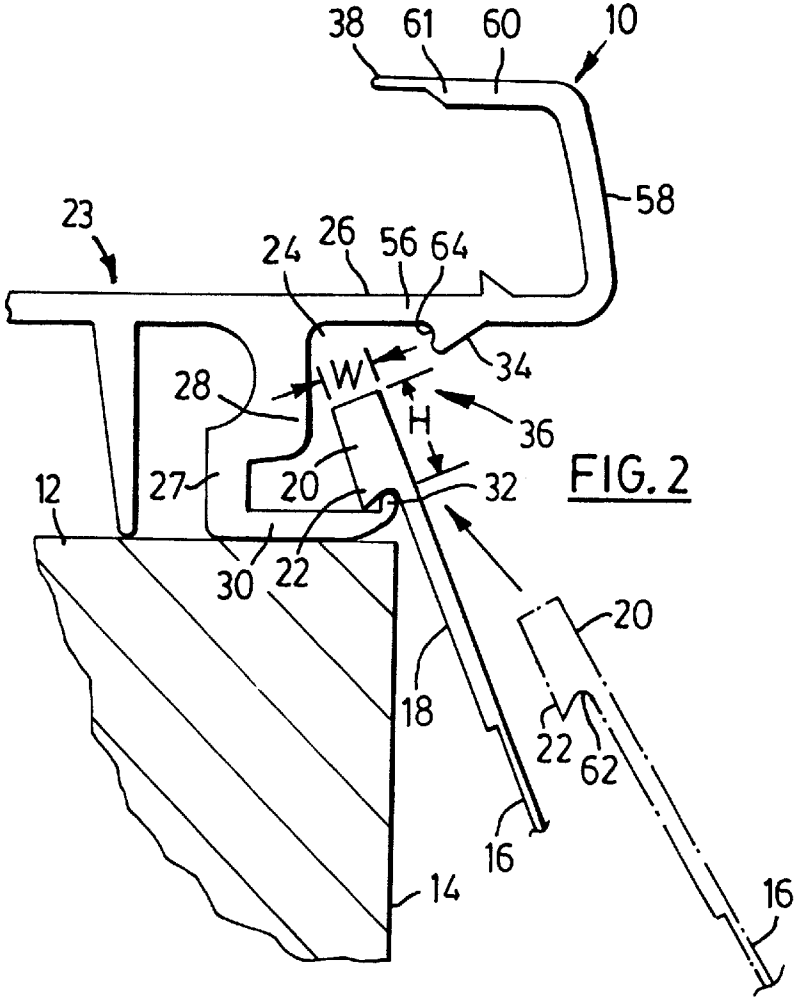
FIG. 2 is a cross-sectional elevation of a portion of the pool liner retainer shown in FIG. 1, which view illustrates the method for inserting the liner bead.

Referring firstly to FIGS. 1 to 3 is a first preferred embodiment of a pool liner retainer according to the invention is generally indicated by reference numeral 10. Pool liner retainer 10 is shown mounted on a top peripheral edge portion 12 of a structural wall 14 of a swimming pool. The wall 14 shown in FIG. 1 is preferably made of a polymer material having an aluminum frame, but it will be appreciated that it could be made of other materials, such as concrete or steel, or it could have some other construction, if desired. A portion of a pool liner 16 is also shown in the drawings. The liner can be made of sheet vinyl material to form a watertight envelope conforming with the inside structural surfaces of the swimming pool. The liner 16 has a top peripheral edge portion 18 that includes a liner bead 20 that is formed from a much greater thickness of vinyl material. The liner bead has a height H which is greater than its width W and includes an offset lateral edge portion 22. Preferably the liner bead height H is at least twice as great as its width W. The lateral edge portion 22 defines an upwardly extending groove 62 therein. This groove 62 assists in the retention of the pool liner in the retainer as explained hereinafter.

The retainer 10 includes an elongate retaining element 23. The retaining element 23 defines a holding channel 24 which is dimensioned to accommodate the liner bead 20. The holding channel 24 is defined by an upper wall 26, a rear wall 28 and an integral bottom wall 30.

The front of the holding channel 24 is defined by a downwardly extending second flange 34 extending from a first horizontal section 56 of the upper wall 26. The section 56 is connected to a second portion 58 positioned forwardly and extending upwardly from the first portion 56. A third portion 60 of the upper wall extends rearwardly from the upper portion of the second portion to a rear end portion 61. A third flange 38 extends rearwardly from the rear end portion 61.

The holding channel 24 has an integral bottom wall 30. The bottom wall has a forwardly positioned upwardly extending first flange 32. A downwardly extending second flange 34 extends toward the bottom wall 30. The area between the bottom of the second flange 34 and the top of the first flange 32 forms a slot 36 (see FIG. 2) for insertion of the liner bead 20 into the holding channel 24.

As shown in FIG. 2, the liner bead 20 is inserted through this slot 36 into the channel 24. The lateral edge portion 22 of the liner bead is positioned rearwardly of the first flange 32 with the first flange 32 inserted into groove 62 at the bottom of the lateral edge portion 22. It will be particularly noted that the bead 20 stands up substantially vertically unlike some prior art arrangements where this bead extends horizontally.

As shown in FIGS. 1 and 3, a resilient cap 40 defines a longitudinal cavity 42. The cap has a first hooked peripheral edge portion 44 adapted to be hooked over the second flange 34. Preferably the second flange 34 includes a substantially vertical rear wall 64 (see FIG. 2) and the first hooked peripheral edge portion 44 includes a vertical inner side surface 66 for engagement with the second flange rear wall 64. An opposed second hooked peripheral edge portion 46 is adapted to be hooked over the third flange 38, which extends rearwardly from the rear end portion 61. Preferably the second hooked peripheral edge portion 46 defines a groove 68 for accepting the third flange 38.

FIG. 3 illustrates the insertion of the cap 40 into place on the retaining element 23. The cap 40 is retained on retaining element 23 by snapping the first hooked peripheral edge portion 44 and the second hooked peripheral edge portion 46 over the respective second flange 34 and third flange 38. More specifically the cap 40 is snapped into engagement with the retaining element 23 by positioning the inner side surface 66 of the first hooked edge portion 44 against said second flange rear wall 64 and subsequently snapping the second opposed hooked peripheral edge portion groove 68 into engagement over the third flange 38. The first peripheral edge portion 44 has a transverse, downwardly disposed shoulder 48. When the cap 40 is retained on the retaining element 23, the shoulder 48 extends toward the first flange 32 but is spaced from the first flange a distance sufficient to allow the width W of the liner bead to pass therethrough, but not sufficient to allow the height H of the liner bead to pass therethrough.

Alternately the cap 40 may be snapped into engagement with the retaining element by positioning the second opposed hook peripheral edge portion 46 into engagement over the third flange 38 and subsequently pressing the first hooked peripheral edge portion 44 over second flange 34 the inner side surface 66 engages with the second flange rear wall 64.

When the swimming pool is filled with water to exert pulling forces on the liner 16, the liner bead 20 will move to the position shown in FIG. 3 with the first flange 32 positioned in groove 62 and the cap shoulder 48 preventing the liner bead 20 from being pulled out. It should be understood that the cap shoulder 48 should engage a sufficient portion of the bead to prevent it from being removed.

Figure 4:
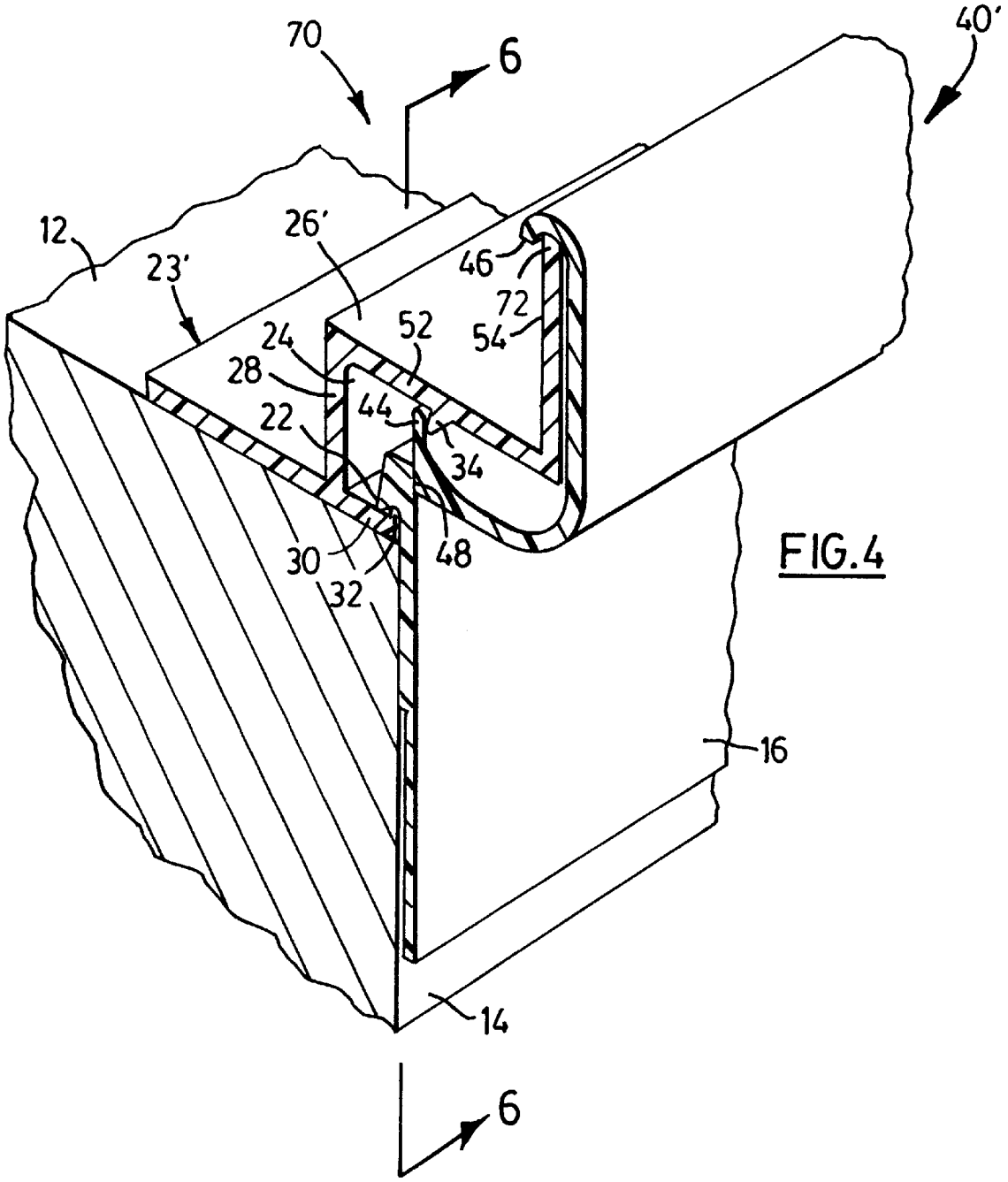
FIG. 4 is a sectional perspective view similar to FIG. 1 but showing a second embodiment of pool liner retainer constructed in accordance with the present invention.
Figure 6:
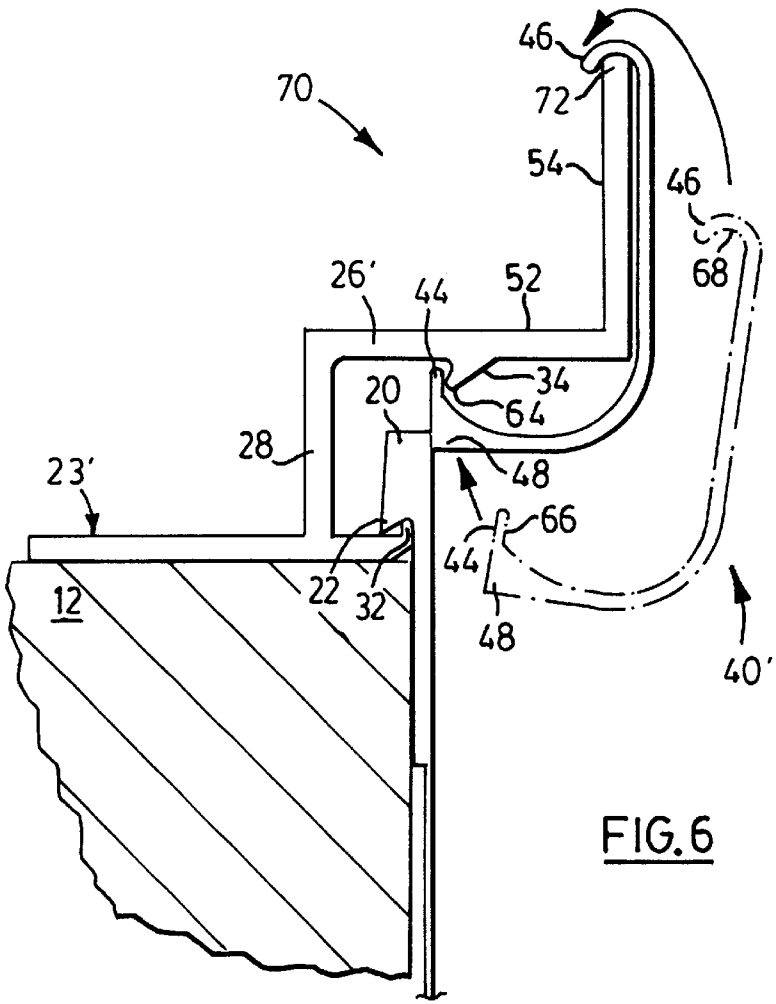
FIG. 6 is a cross-sectional view taken along lines 6—6 of FIG. 4 illustrating how the cap is attached to the retaining element in order to hold the liner bead in the holding channel.
Figure 5:
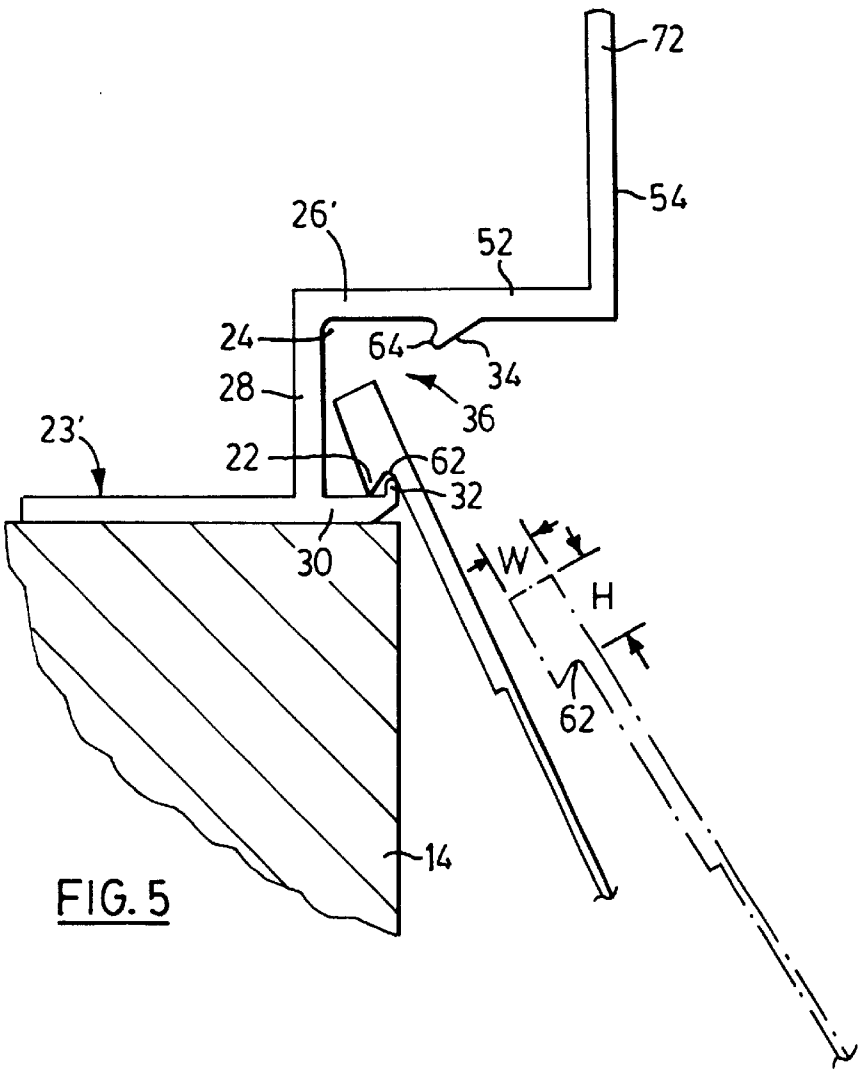
FIG. 5 is a cross-sectional elevation of a portion of the pool liner retainer shown in FIG. 4, which view illustrates the method for inserting the liner bead.

Referring next to FIGS. 4 to 6, a second preferred embodiment of a pool liner retainer according to the present invention is generally indicated by reference numeral 70.

Retainer 70 is similar to the embodiment of FIGS. 1 to 3, except that retainer 70 has an upper wall 26' and a cap 40' that differ from the upper wall 26 and cap 40 of the embodiment of FIGS. 1 to 3. In this second embodiment, the upper wall 26' includes a horizontal first portion 52 and an upright second portion 54 positioned forwardly and extending upwardly from the first portion 52. The second portion 54 includes an upper end portion 72, which becomes the third flange for retainer 70. The second flange 34 is positioned on the first portion 52 of the upper wall 26' and the third flange 72 extends upwardly at the upper end of the second portion 54 of the upper wall 26'.

The cap 40' of this second embodiment shown in FIGS. 4 to 6 may be snapped into place in the same manner as the first embodiment, shown in FIGS. 1 to 3. In particular, cap 40' is snapped into engagement with the retaining element 23' by positioning the inner side surface 66 of the first hooked edge portion 44 against the second flange rear wall 64 of second flange 34 and subsequently pressing the second opposed hooked peripheral edge portion 46 over upper end portion or third flange 72 so that groove 68 engages said third flange 72.

Alternately the cap 40' may be snapped into engagement with the retaining element by positioning the second opposed hooked peripheral edge portion 46 over third flange 72 with groove 68 in engagement over the third flange 72, and then subsequently pressing first hooked edge portion 44 over second flange 34 until inner side surface 66 snaps into engagement with the second flange rear wall 64.

Figure 7:
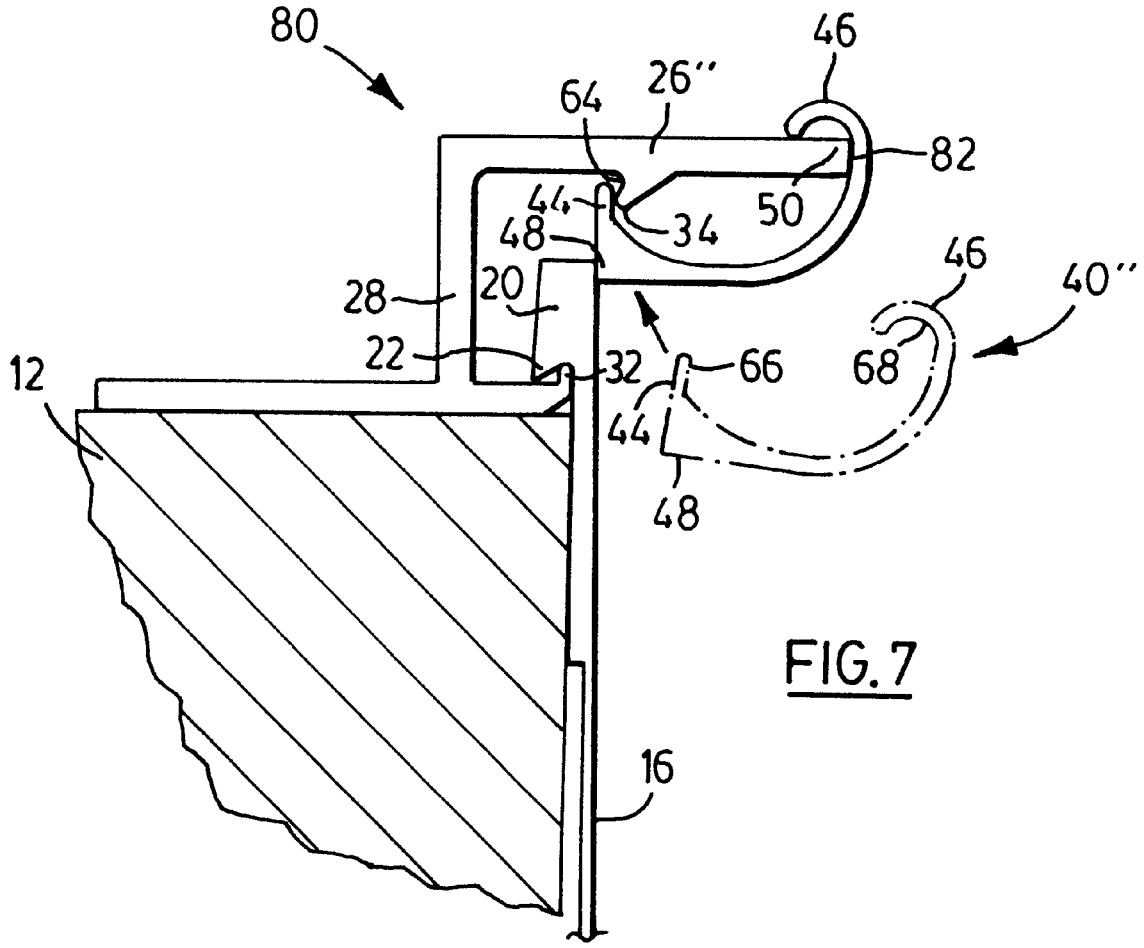
FIG. 7 is a cross-sectional view similar to FIGS. 3 and 4 showing yet another embodiment of a pool liner retainer constructed in accordance with the present invention.

Referring next to FIG. 7, a further preferred embodiment of a pool liner retainer according to the present invention is generally indicated by reference numeral 80. Retainer 80 has an upper wall 26" extending to a front end portion 50 which also forms third flange 82 extending forwardly from the front end portion 50. A cap 40" used with this embodiment is shaped to snap into engagement in this embodiment by positioning the inner side surface 66 of the first peripheral edge portion 44 against the second flange rear wall 64 and subsequently pressing the second opposed hooked peripheral edge portion 46' over third flange 82 so that groove 68 engages the third flange 82. Alternately, the second hooked edge portion groove 68 may first be placed over the third flange 82 and the first peripheral edge portion 44 can be snapped over second flange 34 so that the inner side surface 66 of the first edge portion 44 snaps into engagement with the rear wall 64 of the second flange 34.

The liner bead 20 can be removed from the retainers of the above embodiments of the invention without the need for removal of the cap 40 simply by pushing the bead 20 from its vertical position to a horizontal or diagonal position, and then removing the bead horizontally or diagonally between the gap or slot 36 between the first flange 32 and the cap shoulder 48, which slot 36 was described above as being greater than the width W of the bead but less than the height H of it. In the embodiment shown in FIGS. 1 to 3, the distance between a lower portion 27 of the rear wall and the first flange 32 is greater than the height H of the liner bead, allowing the bead to be moved to a horizontal position while within the channel 24. The moving of the bead to a fully horizontal position within the channel is not necessary in the embodiments shown in FIGS. 1 to 7, since the bead may be removed diagonally from the channel. However, where the gap between the cap shoulder 48 and first flange 32 is only slightly greater than the width W of the bead, it may be necessary to turn the bead to a substantially horizontal position to have it be removed from the channel.

It will also be appreciated that the cap of the embodiments described above may be easily removed by disengaging the one of the hooked peripheral edge portions 44, 46 from the respective second and third peripheral flanges.

Although in the preferred embodiments, polyvinyl chloride is used as the basic material for the retainers, the retaining element and the clip could be extruded from aluminum. Also, any other suitable plastics material could be used for the retaining element and the cap. An example of another type of plastics material is a product referred to as DELRIN, which is a trademark of E.I. Dupont de Nemours & Co. of Wilmington, Delaware. DELRIN is an acetyl-resin type plastic with high fatigue resistance and a generally uniform spring constant characteristic.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A retainer for a pool liner having a bead with a height greater than its width and an offset lateral edge portion, the retainer comprising;

an elongate retaining element including means defining a longitudinal holding channel for accommodating said pool liner bead, said holding channel having an upper wall, a rear wall and a bottom wall; the bottom wall having a forwardly positioned upwardly extending first flange; the upper wall having a downwardly extending second flange, said second flange extending from said upper wall toward said bottom wall, the area between the bottom of said second flange and the top of said first flange forming a slot for insertion of the liner bead into said holding channel; the upper wall also having a remotely extending third flange spaced from said second flange and positioned outside of said channel;

an elongate resilient cap defining a longitudinal cavity therein; the cap having a first hooked peripheral edge portion adapted to be hooked over said second flange, and an opposed second hooked peripheral edge portion adapted to be hooked over said third flange, the cap being retained on the retainer by snapping the hooked peripheral edge portions over the respective second and third flanges; the first peripheral edge portion having a transverse, downwardly disposed shoulder extending toward the first flange but spaced from the first flange a distance sufficient to allow the width of the liner bead to pass therethrough but not sufficient to allow the height of the liner bead to pass therethrough;

whereby the liner bead can be inserted into the retaining element with the liner bead lateral edge portion rearward of the first flange so that downward forces acting on said pool liner will cause said liner bead lateral edge portion to hook onto said first flange and swing into engagement with the cap shoulder, the cap shoulder thereby preventing separation of said liner bead from said holding channel.

2. A retainer as recited in claim 1 wherein said upper wall includes a front end portion, said third flange extending forwardly from said front end portion.

3. A retainer as recited in claim 1 wherein said upper wall includes a first portion defining the top of the channel and a second portion positioned forwardly and extending upwardly from said first portion, said second portion including an upper end portion, said second flange positioned on said first portion and said third flange extending upwardly from the upper end portion.

4. A retainer as recited in claim 1 wherein said upper wall includes a horizontal first portion, a second portion positioned forwardly and extending upwardly from said first portion, and a third portion extending rearwardly from said second portion, said third portion having a rear end portion, said second flange being positioned on said first portion and said third flange extending rearwardly from said rear end portion.

5. A retainer as recited in claim 1, wherein said first flange is adapted to be inserted in an upwardly extending groove formed in the liner offset lateral edge portion when the liner bead is positioned in said retaining element.

6. A pool liner retainer according to claim 1, wherein said upwardly extending first flange is disposed slightly rearwardly of the downwardly extending second flange.

7. A retainer as recited in claim 1 wherein said second flange includes a substantially vertical rear wall and said first hooked peripheral edge portion includes an inner side surface for engagement with said second flange rear wall and said second hooked peripheral edge portion defines an inner groove for accepting said third flange.

8. A retainer as recited in claim 7 wherein said cap is snapped into engagement with said retaining element by positioning said inner side surface against said second flange rear wall and subsequently pressing said second hooked peripheral edge portion groove into engagement over said third flange.

9. A retainer as recited in claim 7 wherein said cap is snapped into engagement with said retaining element by positioning said second hooked peripheral edge portion groove into engagement over said third flange and subsequently pressing said vertical side surface into engagement with said rear wall of said second flange.

10. A retainer as recited in claim 1 wherein said cap is formed of resilient plastic.

11. A retainer as recited in claim 1 wherein said cap is formed of polyvinyl chloride.

12. A swimming pool liner and retainer assembly comprising in combination:

a pool liner including a waterproof sheet having a top peripheral edge portion including a liner bead, said liner bead having a height greater than its width and an offset lateral edge portion;

a retainer including elongate retaining element including means defining a longitudinal holding channel for accommodating said pool liner bead, said holding channel having an upper wall, a rear wall and a bottom wall; the bottom wall having a forwardly positioned, upwardly extending first flange; the upper wall having a downwardly extending second flange, said second flange extending from said upper wall toward said bottom wall, the area between the bottom of said second flange and the top of said first flange forming a slot for insertion of the liner bead into said holding channel; the upper wall also having an outwardly extending third flange; and an elongate resilient cap defining a longitudinal cavity therein; the cap having a first hooked peripheral edge portion adapted to be hooked over said second flange, and an opposed second hooked peripheral edge portion adapted to be hooked over said third flange, the cap being retained on the retainer by snapping the hooked peripheral edge portions over the respective second and third flanges; the first peripheral edge portion having a transverse, downwardly disposed shoulder extending toward the first flange but spaced from the first flange a distance sufficient to allow the width of the liner bead to pass therethrough but not sufficient to allow the height of the liner bead to pass therethrough;

said liner bead being inserted into the retaining element with the liner bead lateral edge portion inside the first flange such that downward forces acting on said pool liner will cause said liner bead lateral edge portion to hook onto said first flange and swing into engagement with the cap shoulder, the cap thereby preventing separation of said liner bead from said holding channel.

13. A retainer as recited in claim 12 wherein said upper wall includes a front end portion, said third flange extending forwardly from said front end portion.

14. A retainer as recited in claim 12 wherein said upper wall includes a first portion defining the top of the channel and a second portion positioned forwardly and extending upwardly from said first portion, said second portion including an upper end portion, said second flange positioned on said first portion and said third flange extending upwardly from the upper end portion.

15. A retainer as recited in claim 12 wherein said upper wall includes a horizontal first portion, a second portion positioned forwardly and extending upwardly from said first portion, and a third portion extending rearwardly from said second portion, said third portion having a rear end portion, said second flange positioned on said first portion and said third flange extending rearwardly from said rear end portion.

16. A retainer as recited in claim 12, wherein said offset lateral edge portion defines an upwardly extending groove, said first flange being inserted in said groove when said liner bead is inserted into said retaining element.

17. A pool liner retainer according to claim 12, wherein said upwardly extending first flange is disposed slightly rearward of the downwardly extending second flange.

18. A retainer as recited in claim 12 wherein said second flange includes a substantially vertical rear wall and said first hooked peripheral edge portion includes an inner side surface for engagement with said second flange rear wall and said second hooked peripheral edge portion defines an inner groove for accepting said third flange.

19. A retainer as recited in claim 12 wherein said cap is formed of resilient plastic.

20. A retainer as recited in claim 12 wherein said cap is formed of polyvinyl chloride.

* * * * *